US009598209B1

(12) United States Patent
Maldonado

(10) Patent No.: US 9,598,209 B1
(45) Date of Patent: Mar. 21, 2017

(54) CAP AND SPOUT ASSEMBLY WITH POSITIVE ORIENTATION FEATURES

(71) Applicant: Daisy Brand, Inc., Dallas, TX (US)

(72) Inventor: Jorge Maldonado, Murphy, TX (US)

(73) Assignee: Daisy Brand, LLC, Dallas, TX (US)

( * ) Notice: Subject to any disclaimer, the term of this patent is extended or adjusted under 35 U.S.C. 154(b) by 113 days.

(21) Appl. No.: 14/724,425

(22) Filed: May 28, 2015

Related U.S. Application Data

(63) Continuation-in-part of application No. 14/338,189, filed on Jul. 22, 2014.

(51) Int. Cl.
*B67D 1/00* (2006.01)
*B65D 47/10* (2006.01)
*B65D 47/12* (2006.01)

(52) U.S. Cl.
CPC ..... *B65D 47/106* (2013.01); *B65D 47/122* (2013.01)

(58) Field of Classification Search
CPC B65D 47/106; B65D 47/122; B65D 2251/04; B65D 35/44; B65D 2215/00–2215/06; B65D 47/123; B65D 41/34; B65D 41/3442
USPC ..... 222/153.07, 153.04, 153.09, 153.1, 222/153.01; 220/290, 293, 296, 298
See application file for complete search history.

(56) References Cited

U.S. PATENT DOCUMENTS 3,435,978 A 4/1969 Wittwer
3,973,941 A 8/1976 Augeri
4,568,005 A 2/1986 Jalovec et al.
4,749,108 A 6/1988 Dornsbusch et al.
4,838,429 A 6/1989 Fabisiewicz et al.
4,984,714 A 1/1991 Sledge
5,169,033 A * 12/1992 Shay ..... B05B 11/3045 215/216
5,292,035 A 3/1994 Millar
5,307,955 A 5/1994 Viegas
5,373,965 A 12/1994 Halm et al.
D364,557 S 11/1995 Linner
5,655,687 A 8/1997 Fitten et al.
5,667,107 A 9/1997 Lindsey
(Continued)

FOREIGN PATENT DOCUMENTS

EP 2463213 A1 6/2012
WO WO-2007031330 A1 3/2007

OTHER PUBLICATIONS

International Search Report dated Oct. 2, 2014 in corresponding international application PCT/US2014/039698, 3 pages.

*Primary Examiner* — Patrick M Buechner
*Assistant Examiner* — Jeremy W Carroll
(74) *Attorney, Agent, or Firm* — Gardere Wynne Sewell LLP

(57) ABSTRACT

A food containment and dispensing system includes a collapsible pouch forming a cavity to contain a food product. A spout fitment is coupled to the collapsible pouch and includes a spout that extends from the collapsible pouch. A spout thread extends radially from the spout. The spout thread starts at a spout rib, which defines a spout rib contact surface. A cap is in threaded engagement with the spout, and it includes a cylindrical wall. A cap thread extends radially from the cylindrical wall and terminates at a cap rib, which defines a cap rib contact surface that is in contact with the spout rib contact surface to prevent further rotation of the cap with respect to the spout.

20 Claims, 8 Drawing Sheets

(56) References Cited

U.S. PATENT DOCUMENTS

| | | | | |
|---|---|---|---|---|
| 5,755,360 | A * | 5/1998 | Elliott | B65D 47/103 222/153.07 |
| D398,845 | S | 9/1998 | Wyslotsky | |
| 5,810,184 | A | 9/1998 | Adams et al. | |
| 5,868,288 | A | 2/1999 | Redmond, Sr. et al. | |
| 5,927,566 | A | 7/1999 | Mueller | |
| 6,000,848 | A | 12/1999 | Massioui | |
| D423,361 | S | 4/2000 | Negre | |
| 6,079,594 | A | 6/2000 | Brown et al. | |
| D429,146 | S | 8/2000 | Thibiant et al. | |
| 6,131,806 | A | 10/2000 | Hess, III et al. | |
| 6,152,324 | A | 11/2000 | Baudin | |
| D459,212 | S | 6/2002 | Gobe | |
| 6,415,965 | B2 | 7/2002 | Nyman et al. | |
| 6,431,381 | B1 | 8/2002 | Randall | |
| 6,705,492 | B2 | 3/2004 | Lowry | |
| 7,093,562 | B2 * | 8/2006 | Smothers | A01K 39/0206 119/72 |
| D541,171 | S | 4/2007 | Delmotte et al. | |
| D542,660 | S | 5/2007 | Thomas et al. | |
| 7,413,097 | B1 * | 8/2008 | Adams | B65D 5/746 215/251 |
| D582,790 | S | 12/2008 | Friebe et al. | |
| D604,164 | S | 11/2009 | Miller et al. | |
| D626,860 | S | 11/2010 | Oates et al. | |
| 7,874,466 | B2 | 1/2011 | McConville et al. | |
| D638,719 | S | 5/2011 | Sander | |
| 7,959,036 | B2 | 6/2011 | Koh | |
| 8,087,547 | B1 | 1/2012 | Lindsey | |
| D655,203 | S | 3/2012 | Klint | |
| D659,008 | S | 5/2012 | Gately et al. | |
| D664,862 | S | 8/2012 | Smith et al. | |
| D678,070 | S | 3/2013 | Meeks | |
| D682,101 | S | 5/2013 | Mazurkiewicz | |
| 8,678,215 | B2 | 3/2014 | Steiger et al. | |
| 8,844,767 | B1 | 9/2014 | Bates et al. | |
| 2003/0168423 | A1 * | 9/2003 | Williams | B32B 27/08 215/204 |
| 2005/0092750 | A1 | 5/2005 | Lohrman et al. | |
| 2005/0109796 | A1 * | 5/2005 | Bourque | B65D 81/3261 222/94 |
| 2005/0205618 | A1 * | 9/2005 | Mabee | B65D 5/746 222/541.9 |
| 2006/0000793 | A1 * | 1/2006 | Mavin | B65D 47/103 215/253 |
| 2006/0289376 | A1 * | 12/2006 | Von Spreckelsen | B65D 51/20 215/257 |
| 2008/0017665 | A1 | 1/2008 | Brecheisen et al. | |
| 2008/0247684 | A1 * | 10/2008 | Binks | B65D 47/2031 383/113 |
| 2011/0100945 | A1 * | 5/2011 | Gutierrez | A61J 11/02 215/11.5 |
| 2012/0318798 | A1 | 12/2012 | Domoy | |
| 2015/0217910 | A1 | 8/2015 | Vogel et al. | |
| 2016/0244222 | A1 * | 8/2016 | Sterling | B65D 47/2031 |

* cited by examiner

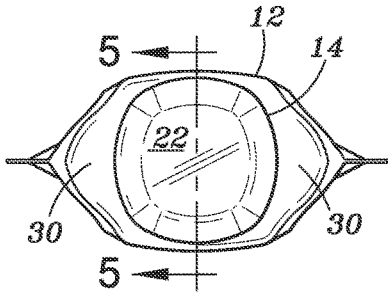
FIG. 3
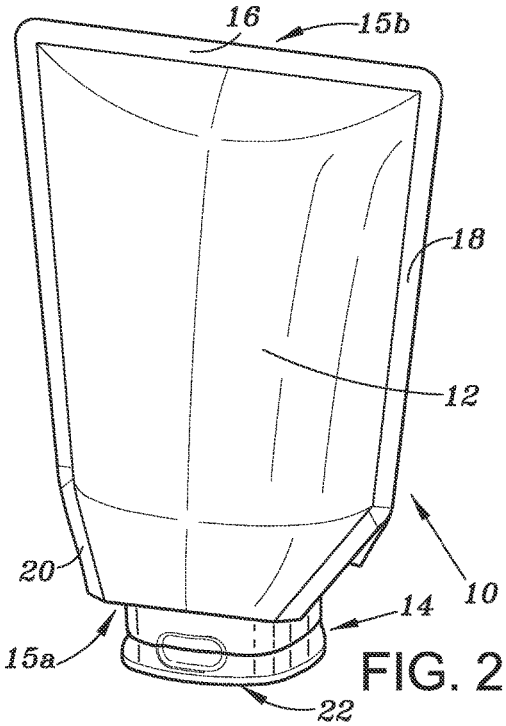
FIG. 2
FIG. 4
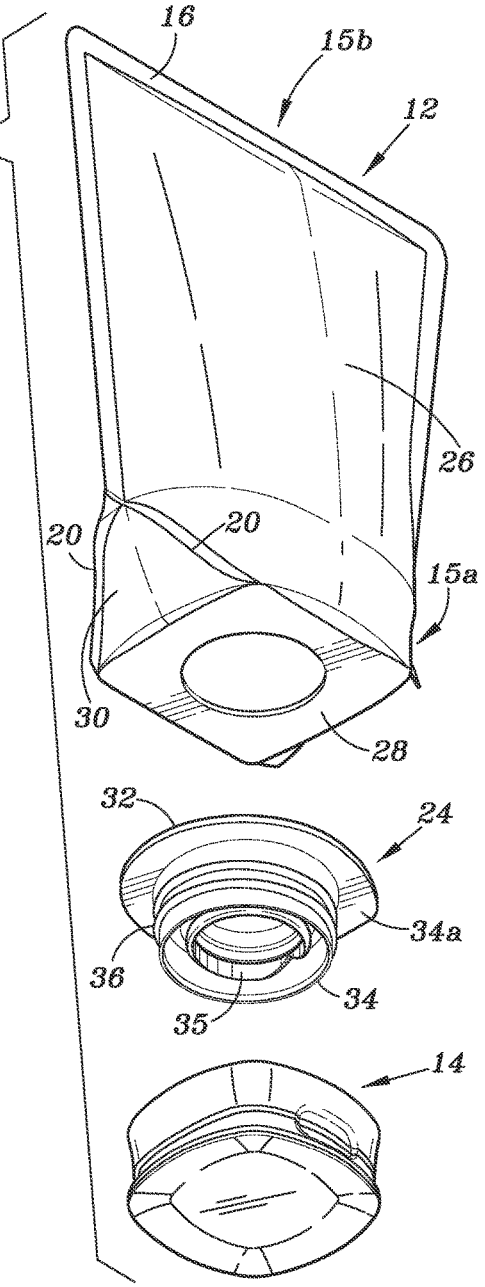

35
28
24
34
100
106
114
102
104

CAP AND SPOUT ASSEMBLY WITH POSITIVE ORIENTATION FEATURES

PRIORITY CLAIM

This application is a continuation-in-part of U.S. patent application Ser. No. 14/338,189 filed Jul. 22, 2014, and entitled "Spout Fitment for Collapsible Package for Food Products," which is hereby incorporated by reference.

RELATED APPLICATIONS

This application is related to U.S. Pat. No. 8,844,767 filed Jul. 6, 2012, and entitled "Food Containment and Delivery System," which is hereby incorporated by reference.

TECHNICAL FIELD

The present disclosure relates generally to containment and delivery of food items, and more particularly to an cap and spout assembly that prevents over-rotation of the cap with respect to the spout and thereby maintains the cap in a predetermined orientation with respect to a collapsible food package.

BACKGROUND

Food packaging serves a variety of functions, such as, for example, safe and generally sterile storage of food product. Of course, packages also function to contain the food product such that it remains fresh and tasty for consumption. In addition to containment of food product, a consumer must also be able to easily dispense the food product conveniently and cleanly. However, different food products present different challenges for its respective packaging. For example, liquid commonly forms in voids or spaces inside sour cream packaging primarily due to "fracturing" or breaking apart of the sour cream, either from transport or use. Thus, when dispensing the sour cream, such liquid is dispensed with or in lieu of the sour cream making the sour cream oftentimes less desirable. Conventional sour cream cup containers, for example, account for such liquid buildup by allowing a user access to the cup container to gently stir the product to blend the sour cream and liquid together before serving; however, such mixing is burdensome and can reduce the freshness of the sour cream.

Dairy products, such as sour cream, must be properly sealed to ensure that the product can be sterilized and remains fresh when the consumer is ready to consume the product. Reference is made to FIGS. 1A and 1B in connection with U.S. Pat. No. 5,810,184 to Adams et al. ("Adams"), which is hereby incorporated by reference and discloses a fitment 50 for use as a pour spout for a paper carton or flexible bag for liquids and powders. The fitment 50 includes a flange 52 which may be welded around a hole in the carton. A spout 54 projects from the flange 52 and includes thread 56 for receiving corresponding thread of a replaceable cap. The fitment 50 includes a removable membrane 58 disposed interior to the spout 54. An outer top surface of the membrane 58 is concave. A horizontally disposed pull ring 60 is attached to the membrane 58 by a vertically extending portion 62 that is reinforced with a vertically extending gusset 64.

To access the contents of the carton or flexible bag, a user typically removes a threaded cap to access the pull ring 60, which begins fracturing the membrane 58 at a tear line 66. Once the frangible membrane 58 is removed the cap functions as the closure for the carton or flexible bag. Thus, the cap is threaded back onto the thread 56 of the spout 54 before the carton or bag is stored in a refrigerator. A cap is typically an axisymmetric generally bowl-shaped, thin-walled plastic part. As such, neither over-rotation of the cap nor orientation of the cap with respect to the spout 54 is typically a concern, provided the threaded engagement is sufficiently secure.

SUMMARY

A food containment and dispensing system includes a collapsible pouch forming a cavity to contain a food product. A spout fitment is coupled to the collapsible pouch and includes a spout that extends from the collapsible pouch. A spout thread extends radially from the spout. The spout thread starts at a spout rib, which defines a spout rib contact surface. A cap is in threaded engagement with the spout, and it includes a cylindrical wall. A cap thread extends radially from the cylindrical wall and terminates at a cap rib, which defines a cap rib contact surface that is in contact with the spout rib contact surface to prevent further rotation of the cap with respect to the spout.

According to certain embodiments, a frangible membrane is internal to the spout, and a pull ring allows the frangible membrane to be removed. A stress concentrator curve reduces a pull force required to initiate a tear of the frangible membrane. Also, the cap may include a valve made of resilient material.

When the user removes the pull ring and threads the cap back onto the spout, the spout rib and the cap rib prevent over rotation of the cap and ensure that the cap is in a known position with respect to the spout and the collapsible pouch.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and the advantages thereof, reference is now made to the following brief description, taken in connection with the accompanying drawings and detailed description, wherein like reference numerals represent like parts, in which:

FIG. 2 is an isometric view of a collapsible package for a food product according to an embodiment of the present disclosure;

FIG. 3 is a top view of the collapsible package of FIG. 1;

FIG. 4 is an isometric exploded view of the collapsible package of FIG. 1 illustrating a spout fitment according to an embodiment of the present disclosure;

DETAILED DESCRIPTION OF THE DRAWINGS

Figure 1A:
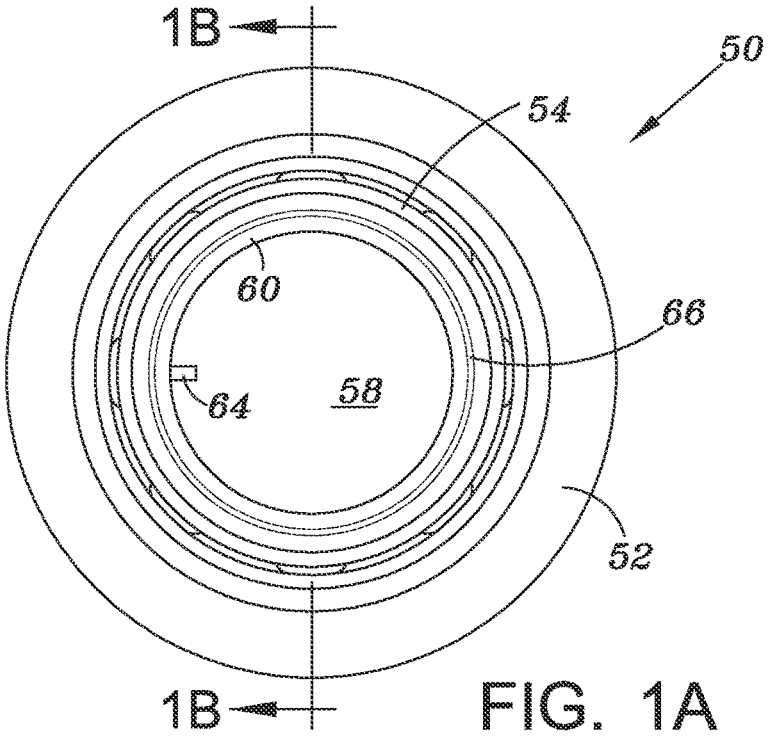
FIG. 1A PRIOR ART
FIGS. 1A and 1B are a top plan view and a cross section respectively of a prior art spout fitment with a frangible membrane.
Figure 1B:
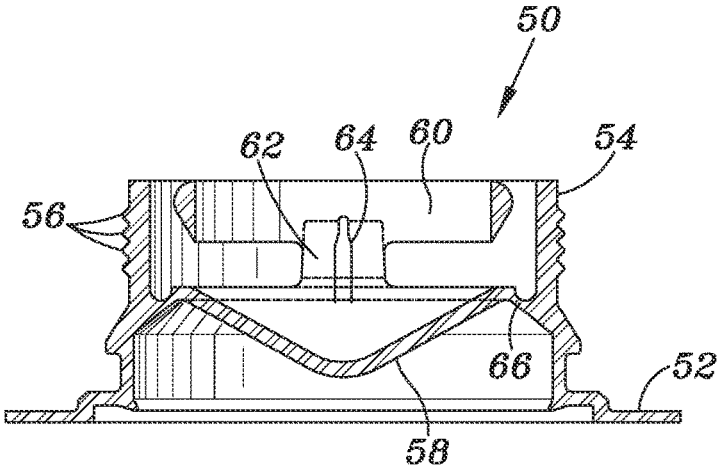
FIG. 1B PRIOR ART

Reference is made to FIG. 2, which shows a food containment and delivery system or collapsible package 10 according to an embodiment of the present disclosure. The food containment and delivery system 10 includes a collapsible pouch 12 and a cap 14 at a dispensing end 15*a*. In the embodiment illustrated in FIG. 2, the collapsible pouch 12 is generally wedge-shaped with a thin non-dispensing end 15*b* disposed opposite the dispensing end 15*a*. Preferably, the collapsible pouch 12 is formed of a metalized film; however, it should be understood that the collapsible pouch 12 may be otherwise formed of any other type of material, such as a foil laminate, a laminar band or sheet of aluminum type foil, a monolayer extruded film, a multi-layered extruded film, a multi-layered laminated film, or a co-extruded film, as examples. When forming the collapsible pouch 12, as explained in greater detail below, a spout fitment 24 (best illustrated in FIG. 4) is secured to the metalized film, which may then be appropriately folded to form the collapsible pouch 12, as shown for example, in FIG. 2.

In the embodiment illustrated in FIG. 2, a plurality of seals are formed on the edges of the foil to form the collapsible pouch 12, which is suitable to contain a food item, such as, but not limited to, sour cream, cottage cheese or whip cream. In FIG. 2, a single horizontal top seal 16 seals the non-dispensing end 15*b* of the collapsible pouch 12 opposite the dispensing end 15*a*. Each end of the top seal 16 intersects a respective longitudinal seal 18 each of which extend from the top seal 16 toward the dispensing end 15*a* of the pouch 12. In the embodiment illustrated in FIG. 2, the longitudinal seals 18 merge into respective pairs of angled seals 20 (best seen in FIGS. 4 and 6). Each of the seals 16, 18 and/or 20 described herein may be formed by heat or by ultrasonically welding portions of the folded foil edges.

In the embodiments disclosed herein, the cap 14 includes a support surface 22 to enable the food containment and delivery system 10, and in particular, the collapsible pouch 12, to be inverted (i.e., the non-dispensing end 15*b* being disposed above the dispensing end 15*a* with the cap facing downward as illustrated in FIG. 2) and supported on a support surface (i.e., a table, shelf, box, etc.). In this manner, gravity causes the contents of the food containment and delivery system 10 (i.e., the product) to remain stable and proximal to the dispensing cap 14 and not be disturbed by repeatedly inverting the system 10. Thus, when it is desired to deliver sour cream or other food product from within collapsible pouch 12, the cap 14 is opened and the collapsible pouch 12 is squeezed to deliver the food product through a valve 40 disposed at the dispensing end 15*a*. Squeezing the collapsible pouch 12 causes it to deform and otherwise collapse. In use, the collapsible pouch 12 provides an indicator of the quantity of dairy product remaining in the container 10 (i.e., when the collapsible pouch 12 is fully collapsed, no food product remains in the collapsible pouch 12). The collapsing action of the collapsible pouch also allows product to be dispensed without creating negative pressure inside the pouch 12, thereby preventing the entry of ambient, unsterile air inside the pouch 12 through the valve 40.

Reference is now made to FIG. 3, which shows the dispensing end 15*a* of the food containment and delivery system 10 of FIG. 2. Although not illustrated, an embodiment of the cap 14 may generally cover the surface area of the dispensing end 15*a*, including two opposed angled portions 30, which provides sufficient surface area of a support surface 22 of the cap 14 to allow the system 10 to remain upright in its inverted orientation, even if the collapsible pouch 12 were to sag or otherwise become displaced away from being aligned with the center of gravity of the system.

In certain embodiments, the support surface 22 may be generally flat, and in an alternate embodiment a perimeter of the support surface may be slightly contoured (i.e., concave). Regardless, the cap 14 and the support surface 22 are sufficiently sized to provide a suitable surface for supporting the food containment and delivery system 10 in an inverted orientation, whether the pouch 12 is completely full, partially full, or even empty.

FIG. 4 illustrates an exploded view of the food containment and delivery system 10 of FIGS. 2 and 3. The spout fitment 24 is disposed at least partially within the collapsible pouch 12 and extends through an opening in the collapsible pouch to receive and secure the cap 14 thereto (see FIG. 5). The spout fitment 24 includes a spout 34, a pull ring 35, and a flange 32, which provides a surface to enable fastening to the collapsible pouch 12. The spout 34 also includes spout thread 36, which receive or are received by corresponding thread on the cap 14 to secure the cap 14 to the spout 34.

The collapsible pouch 12 generally comprises a wedge portion 26, a horizontal portion 28, and two opposed angled portions 30. The width of the collapsible foil pouch 12 generally corresponds to the flange 32. According to embodiments disclosed herein, a spout side 34*a* of the flange 32 is heat or ultrasonically welded or otherwise secured to the inside surface of the horizontal portion 28 of the collapsible pouch 12 (best illustrated in FIG. 5). Subsequently, the sheet of foil is folded and sealed to form the collapsible pouch 12 around the spout fitment 24.

In certain embodiments, the spout 34 may initially be sealed to allow the pouch 12 and the spout fitment 24 to be filled and sterilized. The closed spout 34 facilitates filling the pouch 12 through non-dispensing end 15*b*. To that end, after substantially forming the collapsible pouch 12, the top seal 16 may be left open at the non-dispensing end 15*b*. That is, the top seal 16 may be only partially formed or not formed at all. Thus, the product to be stored within the collapsible pouch 12 may be filled through the open edges of the pouch 12 that ultimately form the top seal 16. Once the collapsible pouch 12 is filled, the top seal 16 is preferably formed by heat or ultrasonic welding to otherwise secure the edges together. Accordingly, the food containment and delivery system 10 may be formed, filled, stored, and transported all while maintaining the system 10 in the inverted orientation, which as previously explained, enables the content of the product stored therein to remain stable with minimal disturbance.

Figure 5:
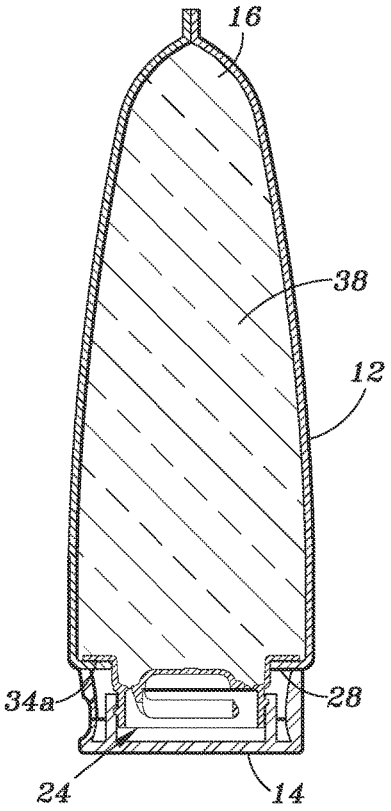
FIG. 5 is a section view of the collapsible package of FIGS. 1 and 2 taken along the line 5-5 of FIG. 3.

FIG. 5 is a section view of the collapsible pouch 12 illustrating its generally wedged shape. Collapsible pouch 12 is sealed as shown and described herein to form a pouch cavity or storage area 38. The pouch 12 may be formed such that the cavity 38 is any desired volume. For example, the pouch cavity 38 may be configured to contain 14 ounces of dairy product in certain embodiments. In other embodiments, the pouch cavity 38 may be sized to contain 16 ounces of product. In other embodiments, for example, the pouch cavity may be sized to contain an amount of product that is less than 14 ounces.

Figure 6:
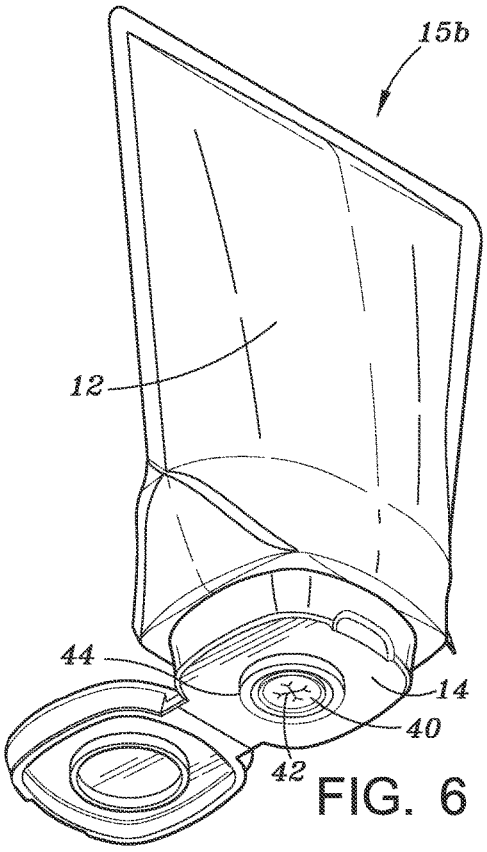
FIG. 6 is an isometric view of a collapsible package with a cap configured in an open position and a valve in a closed position.
Figure 7:
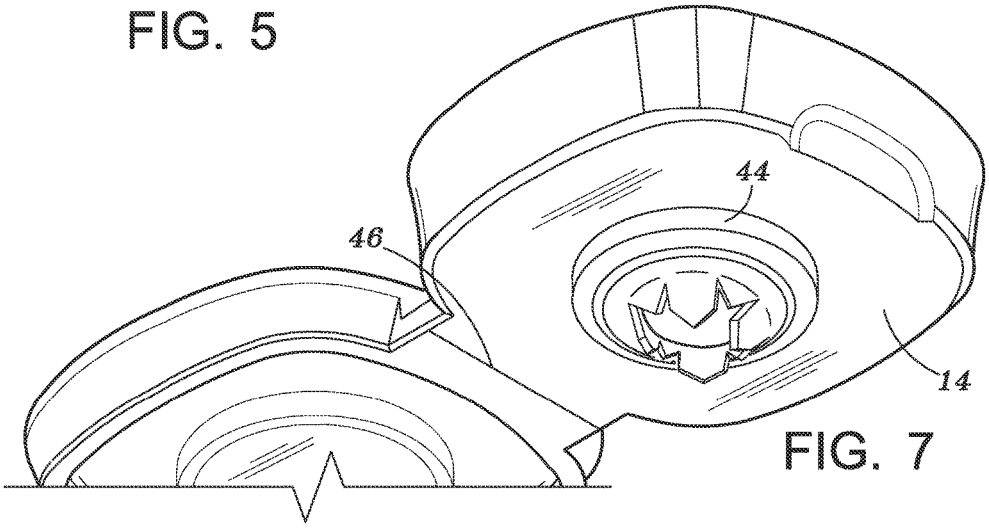
FIG. 7 is a detailed view of the valve of FIG. 6 in an open position.

Reference is now made to FIG. 6, which illustrates the food containment and delivery system 10 with the cap 14 in an open position thereby exposing the valve 40. The spout fitment 24 is not visible, but it is disposed beneath and supports the cap 14. The valve 40, when in a closed position, prevents the contents of the containment and delivery system 10 from inadvertently being delivered or otherwise leaking from the cavity 38. The valve 40 is preferably a perforated membrane of flexible and resilient material. In certain embodiments, the valve 40 may be a silicone membrane with perforations 42. The perforations 42 allow the silicone membrane to configure in an open position as best illustrated in FIG. 7. In its closed position, the valve 40 may be generally recessed into a raised annular portion 44 with perforations generally adjacent each other to seal the cavity 38. When squeezing the collapsible pouch 12 to deliver product from within the cavity 38, a force acts to separate the perforations 42, which opens the valve 40 thereby enabling delivery of the product from the collapsible pouch 12. As the pressure on the pouch 12 is released, the opening force on the valve 40 is removed causing the valve 40, and in particular, the perforations 42, to return to the closed position to seal cavity 38. The valve 40 in turn returns to its recessed position within the raised annular portion 44. In this manner, the valve 40 closes and prevents the product from draining out through the dispensing opening when there is no pressure applied to the collapsible pouch 12.

In operation, the collapsibility of the pouch 12 enables the food product to be dispensed through the valve 40 without creating a negative pressure within the pouch. In particular, because the packaging collapses when dispensing product and such packaging does not have sufficient rigidity to return to its original non-collapsed state, the pouch 12 maintains a positive pressure condition at all times. This prevents the "suck-back" of air and other unwanted contaminants into the cavity 38, thereby reducing the formation of liquid within the cavity 38.

In the embodiments illustrated herein, the cap 14 includes a living hinge 46. The living hinge 46 allows the cap 14 to be a flip-top cap that is flipped open so that the product may be delivered through the valve 40. When the product has been delivered, the cap 14 may be closed and snapped shut via frictional engagement. Thus, the product remains fresh and the containment and delivery system 10 may rest on the horizontal support surface 22 in a generally inverted orientation.

Figure 8:
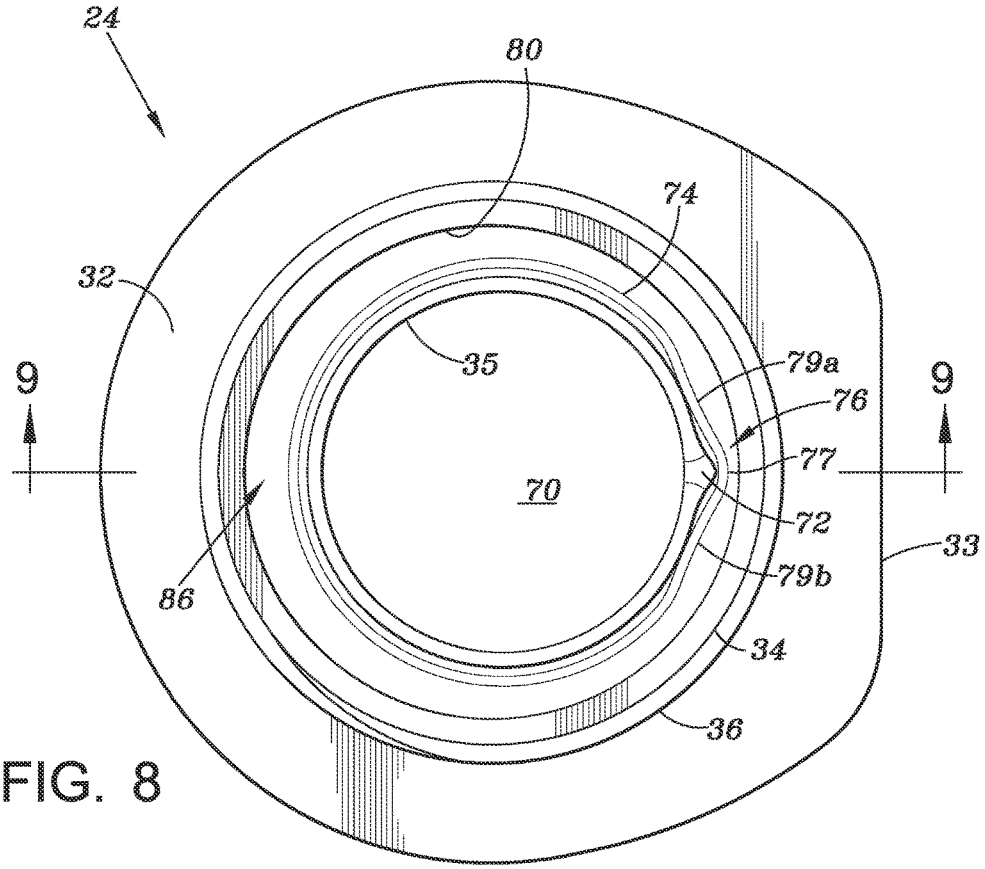
FIG. 8 is a top plan view of the spout fitment of FIG. 4 illustrating a tear path of a frangible membrane.
Figure 9:
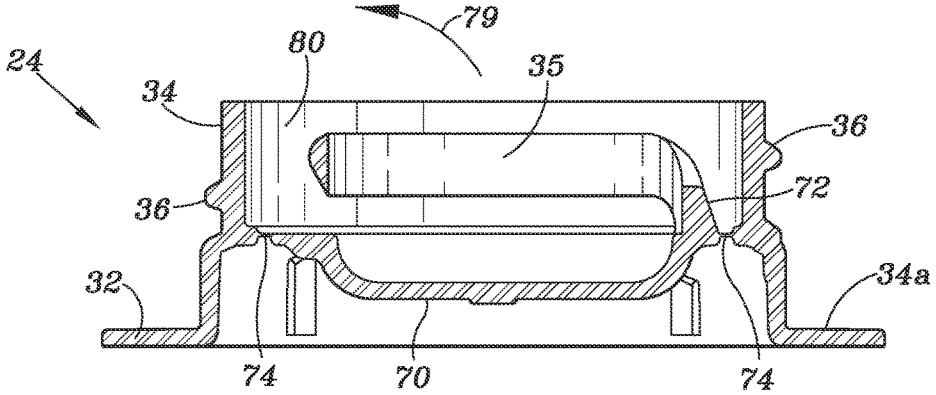
FIG. 9 is a section view of the spout fitment of FIG. 8 taken along the line 9-9.

Reference is now made to FIGS. 8 and 9, which are a top plan view and a section view respectively of the spout fitment 24 shown in FIG. 4. The spout fitment 24 includes a flange 32 about its perimeter. As described above, the flange 32 provides a surface to attach the spout fitment 24 to an inner surface of the collapsible pouch 12. The attaching surface of the flange 32 may include ribs or other features to facilitate welding or other suitable attachment to the collapsible pouch 12. The flange 32 may be nonsymmetrical in that it includes a generally flat edge 33 at a portion of its perimeter. This flat edge 33 facilitates securing the spout fitment 24 in the correct orientation with respect to the collapsible pouch 12 and the cap 14.

The spout 34 extends upward from the flange 32 and has a cylindrical shape and includes thread 36 formed in an exterior surface. The thread 36 receive corresponding thread of the cap 14 when the cap 14 is rotated to be secured to the thread 36 of the spout 34.

Disposed generally in the center of the spout fitment 24 is a frangible membrane 70. The frangible membrane 70 is removably attached internal to the spout 34. A pull ring 35 is also attached to the frangible membrane 70 and is sized sufficiently to allow insertion of an average sized finger of a user, and by grasping and pulling the pull ring 35 rearward and upward, the frangible membrane 70 separates from the spout 34. Removal of the frangible membrane 70 allows the contents of the collapsible pouch 12, such as sour cream or other dairy product, to be dispensed as described herein. Prior to removal of the frangible membrane 70, the food product is sealed in the collapsible pouch 12 and remains fresh. The spout fitment 24 also allows the food containment and delivery system 10 along with the food product contained therein to be sterilized or otherwise made suitable for consumption as a food product.

The pull ring 35 may be annular in shape such that its shape is generally concentric with the spout 34. In an alternate embodiment, the pull ring 35 may follow the shape of a tear path 74. In one embodiment in which the spout fitment 24 is fabricated by injection molding, the outer surface of the pull ring 35 is within the tear path 74 to accommodate certain constraints associated with the injection molding process.

A junction portion 72 of the spout fitment 24 extends downward from the pull ring 35 and joins the frangible membrane 70. As such, pulling the pull ring 35 exerts a pulling force on the frangible membrane 70 and tears the frangible membrane 70 along the tear path 74 such that it can be removed from the spout 34. The tear path 74 defines the opening through which the product will be dispensed, so a wider opening facilitates efficient dispensing of the product. According to the teachings of the present disclosure, the tear path 74 does not follow the cylindrical spout.

Figures 10, 10A:
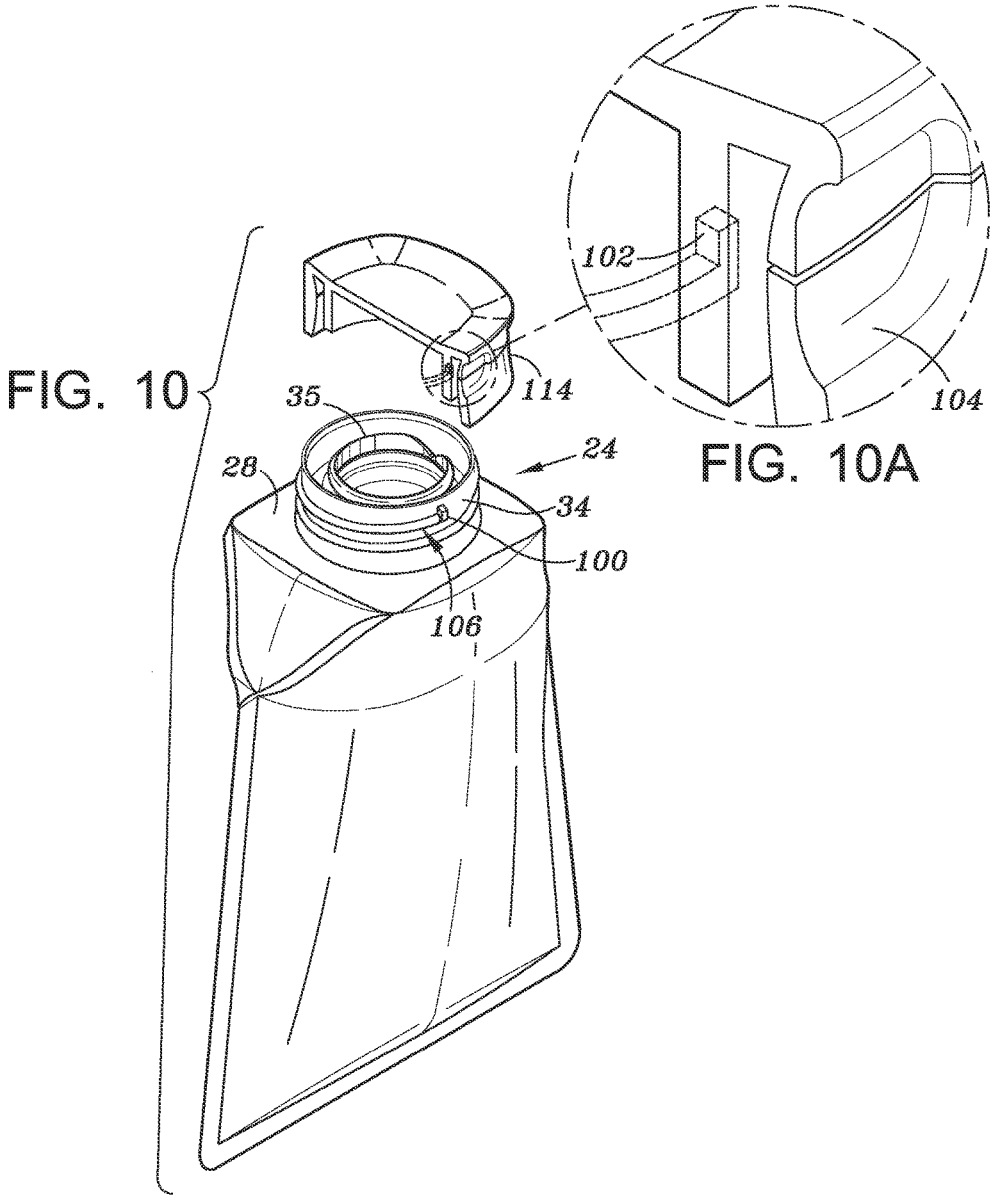
FIG. 10 is a perspective view of the collapsible package with the cap exploded from the spout.
FIG. 10A is a detail view of a portion of the cap shown in FIG. 10.
Figure 11:
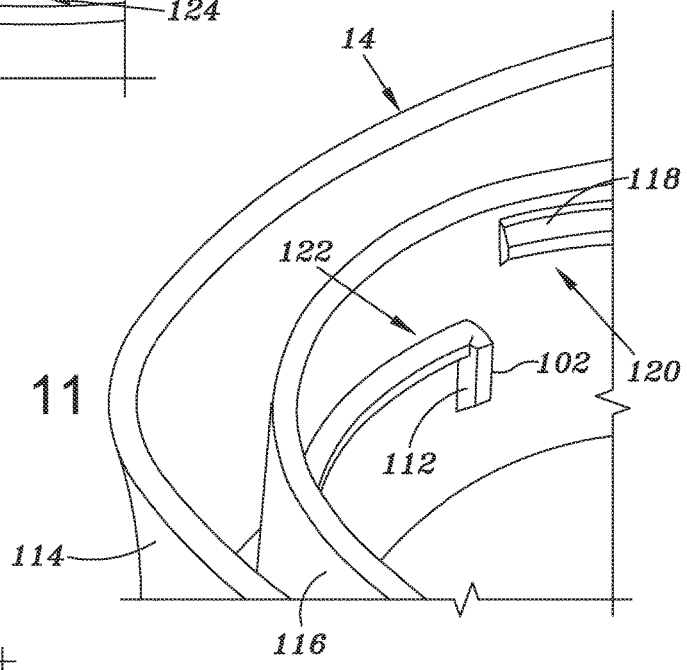
FIG. 11 is a detail view of the cap shown in FIGS. 10 and 10A showing particular features of the cap thread.
Figure 12:
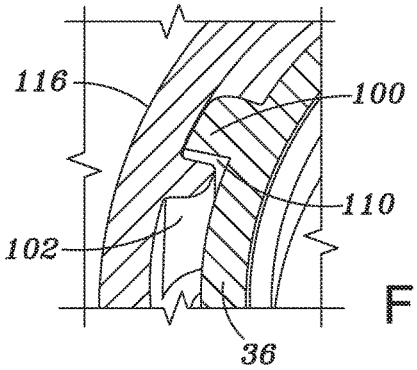
FIG. 12 is a section view showing over-rotation prevention features of the cap and the spout shown in FIGS. 10-11.

Reference is now made to FIGS. 10-12, which illustrate the positive orientation of the cap 14 when it is rotated to be threaded onto the spout 34. The cap 14 is positively maintained at a predetermined orientation with respect to the collapsible pouch 12 when fully rotated onto the spout 34. Also, the cap 14 is prevented from being over-rotated such that it is properly aligned with the horizontal portion 28 of the collapsible pouch 12. The cap 14 is removed to access the pull ring 35 to allow the frangible membrane 70 to be removed such that the contents of the collapsible pouch 12 are accessible. After removing the frangible membrane 70, the user threads the cap 14 back onto the spout 34, and the flip top functions as the closure. Also, the valve 40 of the cap 14 becomes functional after removing the frangible membrane and resecuring the cap 14 to the spout 34.

FIG. 10 illustrates the collapsible package 10 with the cap 14 exploded and sectioned to reveal the positive orientation features of the cap 14 and the spout 34. Specifically, the spout thread 36 includes a spout rib 100 that is configured to contact a corresponding cap rib 102 (see FIG. 12) to prevent any further rotation of the cap 14 with respect to the spout 34. With the spout rib 100 contacting the cap rib 102, the cap 14 is in the orientation with respect to the collapsible pouch 12 shown in FIG. 6. The cap 14 is positioned so that the horizontal portion 28 of the pouch 12 is disposed underneath the cap 14. Without the orientation features, the cap 14 may be unintentionally over-rotated such that the cap 14 hangs over the horizontal portion 28, which may create an undesirable appearance and disturb the balance and structural integrity of the resting inverted package 10. Also, positive orientation of the cap 14 with respect to the collapsible pouch 12 allows a thumb recess 104 to be generally centered on a wide side of the wedge-shaped collapsible pouch 12. In this position, the consumer is able to apply an increased ergonomic leverage to the thumb recess 104 to open the flip-top cap 14.

Figure 10B:
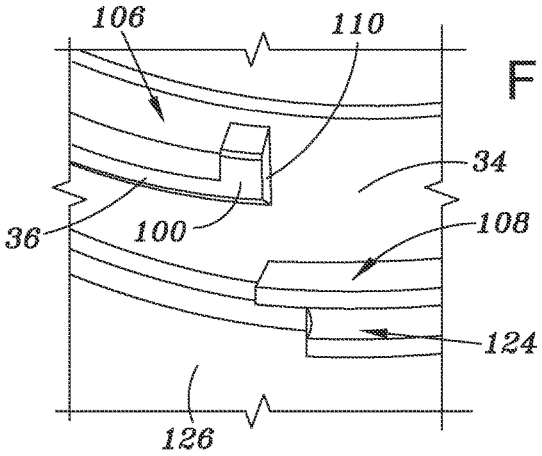
FIG. 10B is a detail view of a portion of the spout shown in FIG. 10.

Reference is made to FIG. 10B, which shows a detail view of a portion of the spout 34. The spout thread 36 extends radially from an outer surface of the cylindrical spout 34. The spout thread 36 is disposed to spiral downward towards the flange 32 (the flange 32 is shown in FIG. 4) of the spout fitment 24. In certain embodiments, a single spout thread 36 begins at a thread start 106 disposed towards a top of the spout 36 and spirals once around the circumference of the cylindrical spout 34 to a spout thread end portion 108 where the thread 36 terminates. The end 108 of the spout thread 36 is disposed generally proximate the start 106 of the spout thread 36, as shown in FIG. 10B. The spout thread 36 starts at the spout rib 100, which extends axially upward toward the top of the spout 34. The spout rib 100 defines a spout rib contact surface 110, which is the surface that contacts a corresponding contact surface 112 of the cap rib 102, as described further below with respect to FIG. 12.

Reference is made to FIG. 11, which illustrates a portion of the inside of an inverted cap 14. A perimeter wall 114 forms the perimeter of the cap 14. Radially internal to the perimeter wall 114 is an inner cylindrical wall 116. A cap thread 118 extends radially inward from the inner cylindrical wall 116. Similar to the spout thread 36, the cap thread 118 spirals from a cap thread start 120 once around the circumference of the inner cylindrical wall 116 to a cap thread end 122 where the thread 118 terminates. The cap thread 118 terminates at the cap rib 102. Similar to the spout thread 36, the cap thread 118 is a single thread that spirals downward to terminate proximate the cap thread start 120, as shown in FIG. 11. The cap rib 102 extends downward from the cap thread 118 and provides a cap rib contact surface 112 that contacts the spout rib contact surface 110 when the two threads are fully engaged. Here, the term downward is used relative to the inverted orientation of the cap 14 shown in FIG. 11 and refers to the direction toward the hole in the cap 14 where the valve 40 is seated.

Reference is made to FIG. 12, which shows a cross-section of the cap rib 102 and the spout rib 100 in engagement. This engagement corresponds to the known positive orientation of the cap 14 with respect to the collapsible pouch 12, as described above. To threadedly engage the cap 14 to the spout 34, the cap thread 118 is received beneath the spout thread 36. While rotating the cap 14, the spout thread 36 directs the cap thread 118 downward towards the base of the spout 34 and thereby directs the cap 14 downward towards the horizontal portion 28 of the pouch 12. Once the cap rotates a complete revolution around the spout 34, the spout rib 100, and more particularly the spout rib contact surface 110 contacts the cap rib 102, and more specifically the cap rib contact surface 112. This contact prevents any further rotation of the cap 14 with respect to the spout 34.

Referring back to FIG. 10B, in certain embodiments, the cap thread start 120 is received by a pocket 124 formed by the end portion 108 of the spout thread 36 and a radially extended base portion 126 of the spout. Referring back to FIG. 10, the spout rib 100 may be disposed at any location on the circumference of the spout 34 provided the cap rib 102 is located to engage the spout rib 100 when fully threaded onto the spout 34. Also, according to an alternate embodiment, the spout thread 36 and the spout rib 100 may be disposed on a radially inner surface of the spout 34, and the cap thread 118 and the cap rib 102 may be disposed on a radially outer surface of the inner cylindrical wall 116.

It is desirable to reduce the pull force required to separate the frangible membrane 70. A conventional fitment with a completely circular tear path requires approximately 6 pounds of pull force to initiate a tear in the frangible membrane. However, according to embodiments of the present disclosure, the required pulling force is significantly reduced. In certain embodiments, the required pulling force is reduced to half the required pulling force of conventional fitments. In one embodiment, a user may apply approximately 3 pounds of pulling force to cause the frangible membrane 70 to begin to separate from the spout 34.

When a user grips the collapsible pouch 12 to oppose the pulling force exerted on the pull ring 35, the user may apply a gripping force, which may unintentionally cause the product to spill or otherwise be forced out of the opening that is created by tearing the frangible membrane 70. However, if the pull force required to initiate tearing of the frangible membrane 70 is reduced, then the required gripping force opposing the pull force may likewise be reduced, which in turn reduces the likelihood that product will be unintentionally squirted or otherwise dispensed by the user. Moreover, the rigid portions of the system 10 are part of the cap 14, which allows the user to maintain the system 10 in an inverted orientation. However, in accessing the pull ring 35 of the spout fitment 24, the cap 14 is removed. Thus, the user is primarily left with the collapsible pouch 12 for gripping in order to oppose the pulling force.

According to an embodiment of the present disclosure, a tear stress concentrator curve 76 is provided proximate the junction 72 of the frangible membrane 70 and the pull ring 35. The tear stress concentrator curve 76 concentrates the pull force applied to the pull ring 35 over a specific portion of the tear path 74 and allows a tear to be initiated at the tear stress concentrator curve 76 with less pulling force. The initial tear stress concentrator curve 76 provides a reduced area over which the pull force exerted on the pull ring 35 is applied. According to one embodiment the stress concentrator curve 76 has a radius between 0.05 and 0.20 inches, for example 0.10 inches. The reduced radius creates a reduced area over a conventional completely circular tear path, which may have a radius of 0.4 to 0.6 inches. The tear path 74 deviates from the circular shape of the spout 34. For example, the initial stress concentrator curve 76 arcs toward the cylindrical spout 34. An apex 77 of the stress concentrator curve 76 may be generally aligned with a center portion of the junction 72 and with the rearward direction of the pull force applied to the pull ring 35 in order to concentrate the pull force on the tear stress concentrator curve 76. The initial tear stress concentrator curve 76 is delimited on each side by inwardly curved arcs 79*a*, 79*b* of the tear path 74.

The tear path 74 is a thinned region of the frangible membrane 70. In certain embodiments, the tear path may be approximately 12% to 20% of the wall thickness of the spout fitment 24, which may range in thickness 0.03 to 0.05 inches. For example, the reference dimension for the wall thickness of the spout fitment may be 0.045 inches and the thickness of the tear path 74 may be approximately 0.0055 inches.

The spout fitment 24 is a thin-walled polymeric part. The spout fitment 24 may be molded from a polymer material, however, it should be understood that any other type of material may be utilized. According to one embodiment, the spout fitment 24 is molded from a suitable polymeric material, such as linear low-density polyethylene. It may be manufactured using any suitable method for molding polymers, such as injection molding.

Once the tear is initiated, the tear will propagate along the tear path 74, first through tear stress concentrator curve 76, specifically the curved portions on each side of the apex 77 that are more aligned with the rearward pull force. The tear will propagate to each of the inwardly curved arcs 79*a*, 79*b* and on around each side of the tear path 74. Generally, the tear will propagate clockwise and counter-clockwise in each direction approximately 180 degrees. Tear propagation after the tear has already been initiated generally requires less pull force than the force required to initiate the tear. The two tear propagations will meet at a location 86 on the tear path approximately 180 degrees from the initial tear stress concentrator curve 76 and the frangible membrane 70 will completely separate from the fitment 24.

Figure 13:
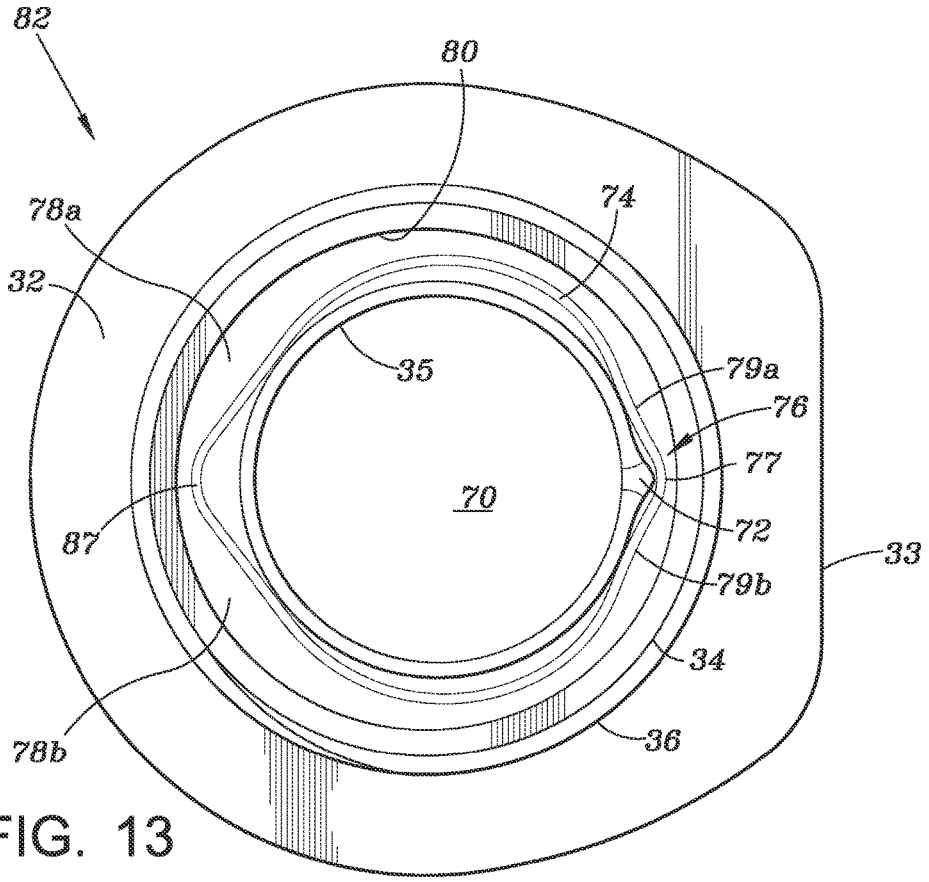
FIG. 13 is a top plan view of an alternate embodiment of a spout fitment with a frangible membrane.

Reference is now made to FIG. 13, which is a top plan view of an alternate embodiment of a spout fitment 82. The spout fitment 82 includes a cylindrical spout 34 extending from a flange 32, which includes a flat 33 similar to the features shown and described with respect to the embodiment shown in FIGS. 8 and 9.

In this embodiment, at the location the two tear propagations approach each other, approximately 180° from the junction 72, a final stress concentrator curve 87 is disposed. The final tear of the tear path 74 that completely separates the frangible membrane from the spout 34 typically requires more pull force than the force required to continue the tear propagation. In some embodiments, the pull force required to complete the final tear may be more than the pull force required to make the initial tear. Similar to the initial tear stress concentrator curve 76, the final tear stress concentrator curve 87 provides a reduced area for the pull force to act on and thereby reduces the amount of pull force required to create the final tear. Reducing the pulling force required to completely separate the frangible membrane 70 reduces the likelihood that the collapsible package will be abruptly moved or shaken by the user immediately after the frangible membrane 70 is completely separated and the user continues to apply the gripping force even though the pulling force has been removed from the package due to the complete separation of the frangible membrane 70.

As the tear propagates, the frangible membrane 70 begins to separate from the spout 34 and the pull force will urge the separated portion of the frangible membrane 70 upward and rearward in the direction of arrow 79 (see FIG. 9). To that end, clearance zones 78*a*, 78*b* provide clearance between the frangible membrane 70 and an inner surface 80 of the spout 34. The clearance zones 78 are portions of the spout fitment 24 disposed on each side of the final stress concentrator curve 87 between the tear path 74 and the spout inner surface 80. Thus, as a rear portion of the frangible membrane 70 is separated along the tear path 74, any interference or contact between the separated frangible membrane 70 and the inner surface 80 is reduced or eliminated. By reducing such contact, no additional pulling force is required to overcome this frictional contact, and thus the frangible membrane 70 is free to separate more easily. The clearance zones 78 are created by disposing the tear path 74 spaced apart from the inner spout surface 80. In some embodiments, this may be a generally straight portion of the tear path 74. In other embodiments, the tear path 74 may curve or arc slightly toward the center of membrane 70. The tear path 74 including the portion of the tear path 74 that accommodates the clearance zones 78 continues to define a sufficient area to allow the product, such as sour cream, to flow through and thereby be dispensed by the consumer.

Figure 14:
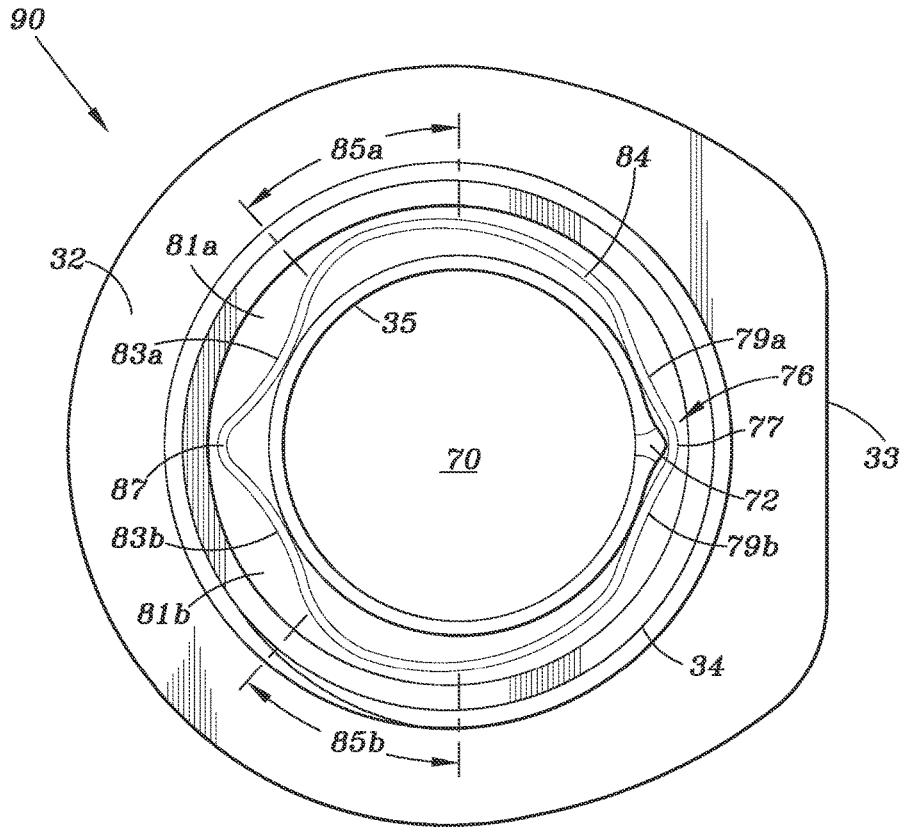
FIG. 14 is a top plan view of a further alternate embodiment of a spout fitment with a frangible membrane.

Reference is now made to FIG. 14, which is a top plan view of an alternate embodiment of a spout fitment 90. The spout fitment 90 includes a cylindrical spout 34 extending from a flange 32, which includes a flat 33 similar to the features shown and described with respect to the embodiment shown in FIGS. 8, 9, and 13. Specifically, it includes the initial tear stress concentrator curve 76, which reduces the pull force required to initiate the initial tear of the tear path 74. However, the tear path 84 of spout fitment 82 deviates from the embodiment shown in FIG. 10. In approaching the final stress concentrator curve 87 at tear path portions 85*a* and 85*b*, which begin approximately 90 degrees from the junction 72 of the pull ring 35 and the frangible membrane 70, the tear path 84 follows close to the spout 34. The tear path 84, and more specifically the tear path areas 85*a* and 85*b* allow for a wider opening than tear path 74 through which product is able to flow when being dispensed. In approaching the final stress concentrator curve 87, the tear path 84 provides clearance zones 81*a*, 81*b* from the spout 34. The clearance zones 81*a*, 81*b* result from inwardly arcuate portions 83*a*, 83*b* of the tear path 84.

Embodiments of the invention have been described and illustrated above. The invention is not limited to the disclosed embodiments. Numerous other changes, substitutions, variations, alterations, and modifications may be ascertained by those skilled in the art and it is intended that the present invention encompass all such changes, substitutions, variations, alterations, and modifications as falling within the spirit and scope of the appended claims.

What is claimed is:

1. A food containment and dispensing system, comprising:

a collapsible pouch forming a cavity to contain a food product therein;

a spout fitment coupled to the collapsible pouch and comprising a spout extending from the collapsible pouch and a spout thread extending radially from the spout, the spout thread starting at and continuing from a spout rib, the spout rib defining a spout rib contact surface; and a cap in threaded engagement with the spout and comprising a cylindrical wall, a cap thread extending from the cylindrical wall and continuing to and terminating at a cap rib, the cap rib defining a cap rib contact surface in contact with the spout rib contact surface to prevent further rotation of the cap with respect to the spout.

2. The system of claim 1 wherein the spout fitment further comprises a frangible membrane disposed internal of the spout, the frangible membrane configured to tear away from the spout along a tear path defined by a reduced thickness of the frangible membrane.

3. The system of claim 2 wherein the spout further comprises a pull ring coupled to the frangible membrane.

4. The system of claim 3 wherein a junction of the pull ring and the frangible membrane is proximate a stress concentrator curve.

5. The system of claim 4 wherein a center of the junction is aligned with a center of the stress concentrator curve.

6. The system of claim 1 wherein the spout rib extends axially from the spout thread toward a top of the spout.

7. The system of claim 6 wherein the cap rib extends axially from the cap thread.

8. The system of claim 1 wherein the collapsible pouch is wedge-shaped and a thumb recess of the cap is disposed generally aligned with a center of a wide side of the collapsible pouch.

9. The system of claim 1 wherein cap is a flip-top cap.

10. The system of claim 1 wherein the spout thread is disposed only once around a circumference of the spout.

11. The system of claim 10 wherein the cap thread is disposed only once around the cylindrical wall of the cap.

12. The system of claim 1 further comprising a valve seated in the cap.

13. The system of claim 1 wherein the spout fitment comprises a flange secured to an inner surface of the collapsible pouch.

14. A system for orienting a cap with respect to a spout, comprising:

a spout fitment comprising a flange and a cylindrical spout extending from the flange, the cylindrical spout having a spout thread originating at and continuing from a spout rib; and a cap configured to threadedly engage the cylindrical spout, the cap comprising a cap thread continuing to and terminating at a cap rib, the cap rib configured to contact the spout rib when the spout thread and the cap thread are engaged and the cap is in a predetermined orientation relative to the cylindrical spout.

15. The system of claim 14 wherein the spout fitment further comprises a frangible membrane disposed internal of the cylindrical spout, the frangible membrane configured to tear away from the cylindrical spout along a tear path defined by a reduced thickness of the frangible membrane.

16. The system of claim 15 wherein the cylindrical spout further comprises a pull ring coupled to the frangible membrane proximate a stress concentrator curve.

17. The system of claim 14 wherein the spout thread is disposed only once around a circumference of the cylindrical spout.

18. A food containment and dispensing system, comprising:

a collapsible pouch forming a cavity to contain a food product therein;

a spout fitment coupled to the collapsible pouch and comprising a spout extending from the collapsible pouch and a spout thread extending radially from the spout, the spout thread starting at and continuing from a spout rib, the spout rib defining a spout rib contact surface; and a cap assembly in threaded engagement with the spout and comprising a valve, a cylindrical wall, and a cap thread extending from the cylindrical wall and continuing to and terminating at a cap rib, the cap rib defining a cap rib contact surface in contact with the spout rib contact surface to prevent further rotation of the cap with respect to the spout; and wherein the collapsible pouch is wedge-shaped and a thumb recess of the cap assembly is disposed generally aligned with a center of a wide side of the collapsible pouch.

19. The system of claim 18 wherein the cap assembly comprises a living hinge.

20. The system of claim 18 wherein the spout fitment comprises a flange secured to an inner surface of the collapsible pouch.

* * * * *